United States Patent [19]

Weil, Jr. et al.

[11] Patent Number: 4,520,707

[45] Date of Patent: Jun. 4, 1985

[54] ELECTRONIC ORGAN HAVING MICROPROCESSOR CONTROLLED RHYTHMIC NOTE PATTERN GENERATION

[75] Inventors: Robert A. Weil, Jr., Dale; Stephen L. Howell, Huntingburg, both of Ind.

[73] Assignee: Kimball International, Inc., Jasper, Ind.

[21] Appl. No.: 565,130

[22] Filed: Dec. 27, 1983

Related U.S. Application Data

[63] Continuation of Ser. No. 358,118, Mar. 15, 1982, abandoned.

[51] Int. Cl.[3] ..... G10F 1/00

[52] U.S. Cl. ..... 84/1.03; 84/DIG. 12; 84/DIG. 23

[58] Field of Search ..... 84/1.03, 1.01, 1.24, 84/DIG. 12, DIG. 22, DIG. 23

[56] References Cited

U.S. PATENT DOCUMENTS

| | | | |
|---|---|---|---|
| 3,878,750 | 3/1975 | Kapps | 84/1.01 |
| 4,038,896 | 8/1977 | Faulkner | 84/1.01 |
| 4,129,055 | 12/1978 | Whittington et al. | 84/1.01 |
| 4,191,083 | 3/1980 | Wilcox et al. | 84/1.28 |
| 4,220,068 | 9/1980 | Howell et al. | 84/1.03 |
| 4,292,874 | 10/1981 | Jones et al. | 84/1.03 |
| 4,339,978 | 7/1982 | Imamura | 84/1.03 |

*Primary Examiner*—Forester W. Isen

*Attorney, Agent, or Firm*—Jeffers, Irish & Hoffman

[57] ABSTRACT

A system for automatically generating an accompaniment note pattern and a bass pattern programmed therein by the player. The system includes a programmable microprocessor wherein two patterns, one sounding in the frequency range of the solo and accompaniment manuals and the other in the frequency range of the pedals, can be programmed into a programmable and reprogrammable memory by the player by means of a separate keypad or one or two octaves of keys on the regular keyboards. The patterns are programmed in without regard to key, and on playback, the microprocessor is responsive to the chord being played at that time on the accompaniment manual to transpose the read out patterns to a compatible key. Means are provided for phase locking simultaneously occurring notes of the two patterns if they are of the same or octavely related frequencies. This is accomplished by causing both notes to be taken off the same divider string if a match of pitch occurs.

4 Claims, 7 Drawing Figures

200
202
204
206
208
210
212
D
CK
Q
$\bar{Q}$
198
214
216
218
220
222
224
326
328
322
324
NP TONE OUT TO DIODE KEYER
NP ENV
D' E' F' G'
ACCOMPANIMENT NOTE PATTERN DATA SELECTOR
STB
OUT
226
228
246
64
60
232
230
HI
LO
OCTAVE WORD
FOOTAGE SELECTION
244
242
240
238
236
234
190
194
196
192
TONE SELECTOR
ENABLE
C C# D D# E F F# G
G# A A# B
306
308
172
164
PITCH WORD
162
A. B. C. D.
166
168
312
310
170
E. F. G.
56
Z' A' B' C'

ELECTRONIC ORGAN HAVING MICROPROCESSOR CONTROLLED RHYTHMIC NOTE PATTERN GENERATION

This is a continuation of application Ser. No. 358,118, filed Mar. 15, 1982, now abandoned.

BACKGROUND OF THE INVENTION

The present invention relates to an electronic organ having means for automatically generating rhythmic patterns in the octaves of the pedals and one or more of the manuals, and in particular to such a system wherein the patterns can be manually programmed by the player.

For some time now, most electronic organs have included an easy play feature wherein various patterns of notes, such as arpeggios, are played automatically and in harmony with chords played on the accompaniment manual. By depressing either a single chord key, in the case of an organ having an automatic chord feature, or a plurality of keys to form a chord on the accompaniment manual, the organic produces a repetitive pattern of notes in the frequency range of either the accompaniment or the solo manual, and these patterns can be played either in place of or concurrently with the playing of notes on the solo manual. Many organs also include an automatic bass feature wherein an automatic bass pattern is played, again in harmony with the chord played on the accompaniment manual. In most cases, the circuitry for producing the note pattern is clocked by the rhythm unit of the organ so that the note pattern or bass pattern which is played is in time with the percussion instrument sounds, such as the drums, cymbals and other percussion instruments simulated electronically. Two examples of such note pattern generators are U.S. Pat. Nos. 4,220,068 and 4,120,225 incorporated herein by reference.

A drawback to many of the known prior art note pattern generation systems is that the patterns are hard wire programmed in a read only memory or other similar device so that the player is limited to selecting one of the patterns developed by the designers of the organ. Although this may not present a problem to the beginning player, once he progresses and becomes more familiar with the patterns, he may desire to provide his own artistic input into composing new patterns. Moreover, as tastes, and fads in music change, many of the patterns which were originally written and programmed into the organ may no longer provide much appeal with the passing of time.

Of course, read only memories can be changed, but this would involve a very expensive retrofitting of existing organs, and even in the case of newly produced organs which are based on older circuit designs, the continual reprogramming of read only memories can prove to be an expensive and time consuming operation from a manufacturing standpoint. A further dificulty lies in the rapidity with which musical tastes and fads change, so that if a new tune or melody becomes popular, there is insufficient time to reprogram the read only memories and install them in production organs before the popularity of the tune or melody has waned. Most modern day electronic organs have their circuitry concentrated into a number of large scale integrated circuit chips, which are often custom designed so that in order to recover the engineering and design costs in the chips, they must be manufactured in large quantities, thereby committing the patterns programmed by the organ designer to a certain number of production organs.

Although some prior art organs have included the capability for programming various note patterns into them, in many cases it is necessary for the player to time the programming with the rhythm unit. This presents a problem because the player must first memorize exactly which pattern he desires, and then play it in perfect synchronism with the rhythm unit so that when it is played back it will also be timed with the rhythm pattern. One prior art system which avoids the necessity for having to program the pattern in synchronism with the free-running rhythm unit is U.S. Pat. No. 4,129,055. In this system, a series of signals corresponding to either chords or single notes are programmed independently of the rhythm and then playback is effected by depressing a playback key each time the chord or note is to be changed. Although this greatly simplifies the programming step, playback is restricted because the player must successively depress the stepping key in time with the rhythm, and this leaves only one hand free to play the melody.

In other prior art automatic note pattern systems, the player may be able to program into a memory a note or bass pattern, but this will often be played back in exactly the same key in which it was patterned. For example, if the pattern is programmed in the key of D, it will be read out of the memory also in the key of D. This presents no problem as long as the pattern is programmed to fit the piece of music to be played, but if the music is transposed to a different key, of if the pattern is recalled at a different time in the musical composition which may not be in the key of D, for example, or if the pattern is recalled while playing a different piece of music, the dissonance between the read out pattern and the music being played by the performer will be quite unpleasant.

A problem which can occur where two patterns are being played simultaneously is that of phase cancellation. For example, if the note pattern produces a tone simultaneously with a tone in the bass pattern that has the same or an octavely related frequency, and if the tones are not exactly in phase, then some phase cancellation will occur. Thus, some means must be provided to protect against phase cancellation in the event that octavely related notes, that is, notes of the same frequency or at least the same pitch, are simultaneously played.

SUMMARY OF THE INVENTION

The note pattern and bass pattern generation system of the present invention overcomes the problems and disadvantages of prior art systems of this type by providing means whereby the player can program his own pattern into a memory independently of the rhythm unit, and then the circuitry will play back the pattern in synchronism with a rhythm unit and transpose the pattern to the appropriate key depending upon the chord played on the accompaniment manual. Any pattern can be programmed into the memory in the key of C by either a separate keypad or several octaves of keys on a manual of the organ. The programming can be accomplished independently of the rhythm unit so that the player can take as much time as he needs to formulate the pattern and can insert blank spots at those points in the pattern where no notes are to be played. Although the pattern is programmed in the key of C, the control circuitry, which in this case is a custom programmed 3870 microprocessor, receives chord words from the chord encoded circuit controlled by the accompaniment manual and transposes the output data so that it sounds in a key which is compatible with the chord being played at that time.

At least two patterns can be stored in the memories of the microprocessor, one pattern to be sounded in the frequency of either the accompaniment or solo manual, and the other pattern, which is a bass pattern, to be sounded in the frequency range of the pedals. The data is outputed from the microprocessor in pitch and octave format with a series of six bit words determining the note of the accompaniment pattern and a series of six bit words determining the notes of the bass pattern.

The pitch words for the accompaniment and bass patterns select respective frequencies by means of frequency selector circuits, or any other tone generator technique, and the selected frequencies are fed through respective divider chains. The divider chains are controlled by the octave words so that an output is taken off the proper stage in the divider chain depending on the octave desired. Alternatively, the selected frequency could be connected to a stage of the divider chain selected by the octave word with the appropriately divided down frequency emerging from the last stage in the divider chain. When the system detects that tones to be played in the accompaniment and bass patterns have the same pitch, one of the frequency selector-divider circuits is disabled and, alternatively, the outputs from two of the stages of the other frequency selector-divider string are selected. This ensures that the two tones are in phase because they are produced by the same divider string and, since the tones are of the same pitch, it makes no difference whether they are produced by two different divider strings having the same pitch input, or the same divider string but merely selected from different outputs. Of course, if the tones to be produced in the accompaniment and bass patterns are of the same octave and pitch, then only one output of one of the divider string would be selected.

The use of a customed programmed microprocessor enables a great deal of flexibility to be built into the system in terms of the types and lengths of patterns which can be programmed, and affording maximum compatability with the other circuitry of the organ. If desired, the microprocessor could be programmed to detect output tone words of the same pitch, although the preferred embodiment utilizes an OR gating arrangement for this purpose.

Specifically, the present invention contemplates an electronic keyboard musical instrument having a keyboard array including a plurality of player actuated switches assigned to the pitches of the musical scale, and a rhthym generator for generating a sequence of rhythmically timed signals independently of the speed at which the switches of the keyboard are played. A microprocessor is provided comprising a pitch information input operatively connected to a particular group of the switches, a chord input, a rhythm input connected to the sequence of rhythmically timed signals, a pitch output, a player programmable memory, and means for reading into the memory, when the microprocessor is in the program mode, data representative of the sequence in which the switches are actuated, the data being written into the memory independently of the rhythm generator. Means interposed between the keyboard array and the chord input produce data representative of a chord played on the keyboard array. The microprocessor includes means for reading the memory and producing sequentially on the pitch output data corresponding to a sequence of pitches having the same interval spacing as the sequence of pitches written into the memory but transposed to the key of the chord played on the keyboard array at the time of playback and at a rate controlled by the rhythmically timed signals produced by the rhythm generator. Tone producing circuitry is responsive to the data on the microprocessor pitch output for producing tones corresponding thereto, and the microprocessor also includes an octave output which carries data representative of the octave in which the tones are to be played.

The invention also relates to an electronic keyboard musical instrument which has a first controllable means for producing a first tone, a second controllable means for producing a second tone, a first divider having an input to which the first tone is connected and a plurality of outputs wherein the first divider string produces on its outputs tones octavely related to each other and to the first tone, and a second divider having an input to which the second tone is connected and a plurality of outputs, wherein the second divider string produces on its outputs tones octavely related to each other and to the second tone. Player controlled means control the first and second controllable means to produce respective tones for normally selecting one output of each of the divider means, and there is provided means responsive to the player controlled means automatically for rendering the circuitry comprising the second controllable means and the second divider means inoperative to produce a tone and for selecting two outputs from the first divider means carrying octavely related tones when the tones to be produced by the first and second controllable means are of the same pitch.

It is an object of the present invention to provide a system for generating accompaniment patterns and bass patterns wherein the player is able to program the patterns into a memory and then play them back at will during a musical performance.

It is a further object of the present invention to provide such a system wherein the patterns are programmed in any given key, and the system then recognizes the key of a chord played on one of the manuals and transposes the patterns during playback so that they are in a key compatible with that chord.

A still further object of the present invention is to provide such a system wherein the patterns can be programmed independently of the rhythm generator, yet played back in synchronism with the rhythm generator so that the pattern is in time with the percussion pattern.

A still further object of the present invention is to provide such a system capable of producing simultaneously two patterns and including means for avoiding phase cancellation between notes in the two patterns having the same pitch.

These and other objects of present invention will become apparent from the detailed description which follows considered together with the appropriate drawing figures.

DETAILED DESCRIPTION

Figure 1:
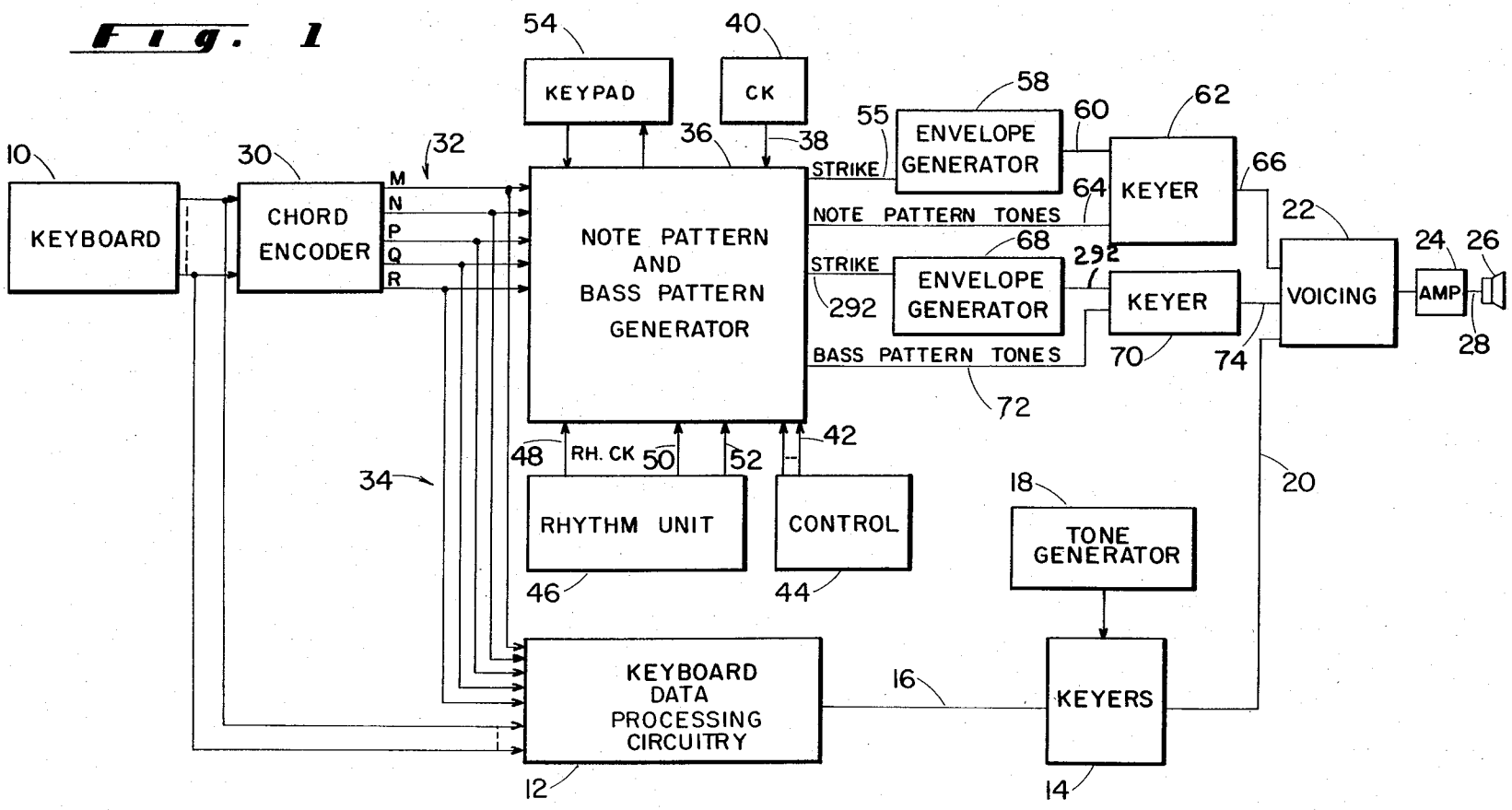
FIG. 1 is a block diagram of an electronic organ including the accompaniment note pattern and bass pattern generator of the present invention.

Referring first to FIG. 1, the organ comprises the customary keyboard 10 which may have a solo and accompaniment manual, for example, as well as a pedalboard. The output of keyboard 10 is connected to a block of circuitry 12 entitled keyboard data processing circuitry, which is the circuitry customarily found in electronic organs for processing the keyswitch and pedal actuation data to actuate the appropriate keyers 14. Circuitry 12 may comprise a multiplexer for multiplexing the keyboard data, a number of easy play features such as automatic chord, automatic glissando, and the like, chime generation circuitry and a demultiplexer. Circuitry of this type is well known to those of ordinary skill in this art and, for this reason, will not be described in detail. The output 16 of keyboard data processing circuitry 12 comprises a plurality of lines connected to keyers 14, which have inputs from tone generator 18. Appropriate keyers 14 are turned on by circuitry 12 so as to produce on lines 20 tones having the appropriate frequency, which are then connected to voicing circuit 22, the output of which is amplified by amplifier 24 having a speaker system 26 connected to its output 28.

The accompaniment manual of keyboard 10 is connected to a chord encoder 30, which generates a five bit MNPQR word on its outputs 32 depending on the chord key or keys depressed on the accompaniment manual. If the organ is in the automatic chord mode, selected keys on the accompaniment manual are dedicated respectively to various chords, and chord encoder 30 detects which key is depressed and develops the MNPQR word in its outputs 32 appropriate to that chord key. In the regular mode, the player must press the appropriate keys to play the chord, and chord encoder 30 interprets the keys pressed to produce the appropriate MNPQR word on outputs 32. Examples of typical chord are disclosed in U.S. Pat. Nos. 4,202,236 and 4,152,965. If desired, the outputs 32 of chord encoder may also be connected by lines 34 to keyboard data processing circuitry 12.

The note pattern and bass pattern generator 36, which is the primary subject of the present application, has five inputs connected to the MNPQR outputs 32 of chord encoder 30, a clock input 38 connected to high frequency clock 40, and a plurality of control inputs 42 connected to function control block 44. A conventional rhythm unit 46, which may be of the type described in U.S. Pat. No. 4,186,639 expressly incorporated herein by reference, has a rhythm clock output 48 which carries a pulse train of relatively low frequency used in note pattern and bass pattern generator 36 for synchronizing the addressing of the patterns. Rhythm unit 46 includes a counter (not shown) driven by a pulse train of the same frequency as that on rhythm clock output 48 and having a plurality of counter outputs. Two such outputs for the Q1 and Q4 outputs 50 and 52 are connected to pattern generator 36. The Q1 pulse train on output 50 is one-half of the frequency on rhythm clock output 48, and the Q4 output 52 pulses once each sixteen counts of the rhythm unit internal counter.

Pattern generator 36 is programmed by means of an external keypad 54, although octaves of keys on one of the manuals of keyboard 10 could also be used for this purpose, if so desired. Output 56 from pattern generator 36 carries the strike pulse for the accompaniment note pattern and is connected through envelope generator 58 to the control input 60 of keyer 62. Envelope generator 58 converts the strike pulse to a conventional keying envelope having an attack and decay of exponential shape, or an ADSR envelope in the case of percussion keying. The tones for the accompaniment note pattern are brought out of pattern generator 36 on output 64 and is connected to the tone input of keyer 62. Keyer 62 functions in the customary manner by keying the tone on input 64 with the envelope on 60 to produce a keyed tone on output 66, which is connected through voicing circuit 22 and amplifier 24 to the output speakers 26. In a similar fashion, the strike pulses for the bass pattern pass through envelope generator 68 and are connected to the control input of bass pattern keyer 70, which has its tone input connected to the bass pattern tones on line 72. The output 74 of keyer 70 is connected through voicing circuit 22 and amplifier 24 to speakers 26.

Pattern generator 36 is programmed by keypad 54 independently of rhythm unit 46, and in the playback mode it produces on outputs 64 and 72 tones in the accompaniment note and bass patterns that were programmed in, but which are in a key compatible with the chord word present on inputs 32 at that time. The pattern generator has its own envelope generators 58, 68 and keyers 62, 70, so that the accompaniment note and bass patterns can be produced simultaneously with notes generated directly by the keyboard.

Figure 2:
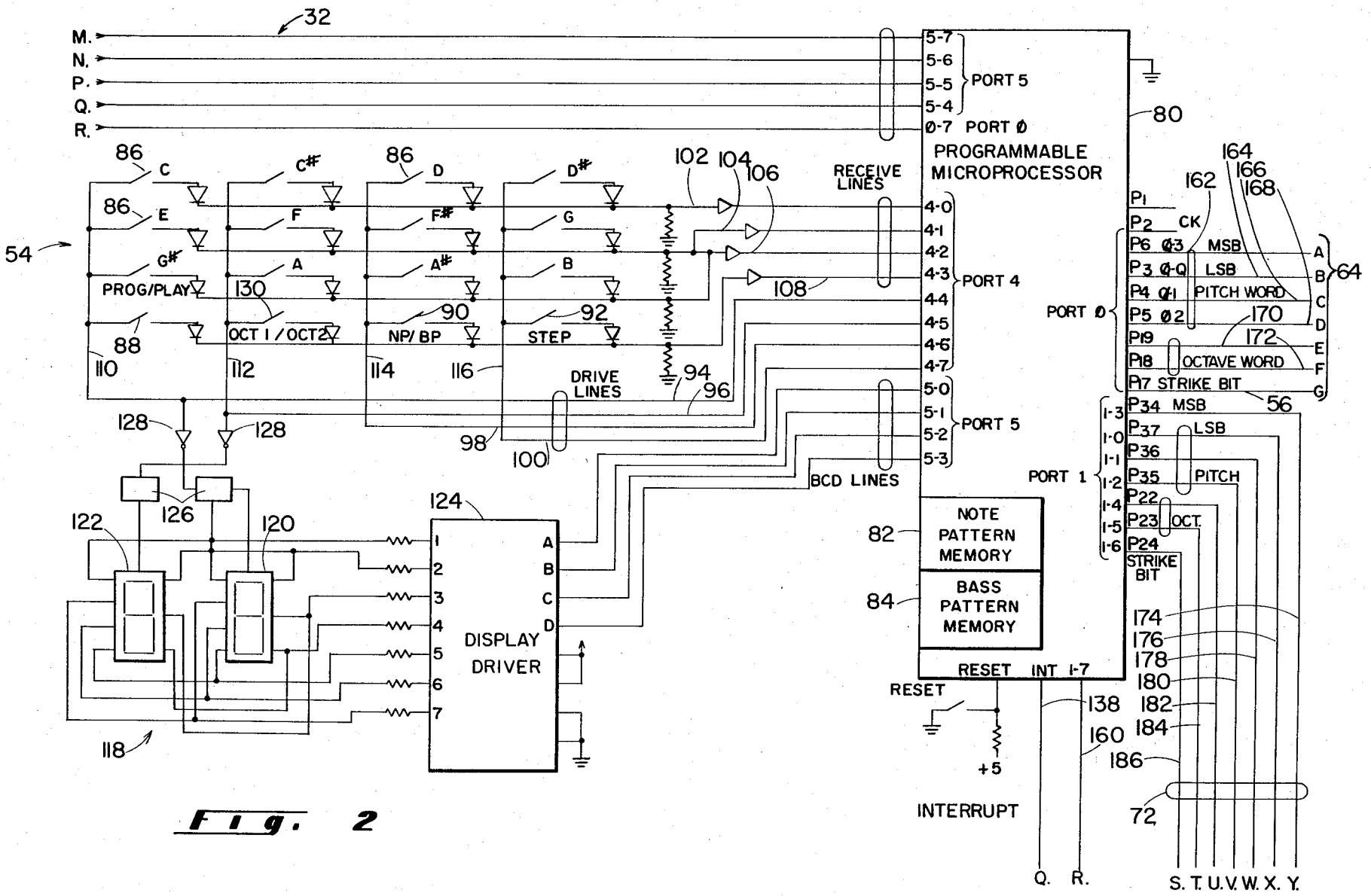
FIG. 2 is a detailed schematic showing the programmable microprocessor and the keypad input thereto.

Referring now to FIG. 2, at the heart of the pattern generation system is a 2K ROM 3870 microprocessor, which is manufactured by several companies, such as Mostek. The routine of microprocessor 80 is internally programmed and includes memory areas 82 and 84 for the note pattern and bass pattern to be programmed in by the player using the keypad 54. Port 5 of microprocessor 80 has connected thereto the MNPQR outputs 32 from chord encoder 30 (FIG. 1). The accompaniment note pattern is programmed in by the player using keypad 54 which comprises a plurality of pitch switches 86 for the twelve notes of the chromatic scale, a program play switch 88, an accompaniment note pattern/bass pattern selector switch 90 and a step switch 92, the latter being actuated between notes programmed and actuated twice for rests when no note is to be played for that particular beat of the pattern.

The switches of keypad 54 are multiplexed by drive lines 94, 96, 98 and 100 connected to pins 4-4, 4-5, 4-6 and 4-7 of port 4 of microprocessor 80, and by receive lines 102, 104, 106 and 108 connected to pins 4-0, 4-1, 4-2 and 4-3 of port 4. Drive lines 94, 96, 98 and 100 cause busses 110, 112, 114 and 116 to go successively high thereby inputing the switch actuation data from the switches connected to the particular bus high at that time into microprocessor 80. If the system is in the program mode by actuating momentary switch 88, the successive actuation of the pitch switches over sixteen frames will program into the note pattern memory 82 or bass pattern memory 84, depending upon the state toggled by momentary switch 90, the pitches which are to be played in the programmed pattern. For example, if the player wishes to program in the notes C, E and G separated by rests, he would close the C key 86, then the step key 92 twice, then the E key 86, then the step key 92 twice again, and finish with the G key 86. If the pattern were to contain nothing else, then the step key 92 would be pressed 12 more times thereby completing the full sixteen time frames. Obviously, more complex patterns can be programmed in depending upon the combination of switches depressed. If switch 90 is pressed, the software toggles the logic so that the pattern will be programmed into the note pattern memory 82, and if switch 90 is pressed again, it will be programmed into bass pattern memory 84.

In order to enable the player to keep track of the frames in which the program data is entered, a seven segment LED display 118 is provided. It includes standard seven segment LED devices 120 and 122 driven by a 4511 display driver 124. The driving of displays 120 and 122 is multiplexed by drive lines 94 and 96 connected through killer drivers 126 and inverters 128. If desired, a display indicating whether the system is in the program or play mode and whether bass or accompaniment note patterns are being programmed may also be provided. Switch 130 enables the programming to be accomplished in either a high or low octave so that the pattern can span two octaves in frequency. Alternatively to this technique of providing a separate octave switch 130, two octaves on the regular keyboard could be dedicated to the programming so that the player need not switch from one frequency range to another during programming.

It is important to note that the programming is accomplished independently of the rhythm unit so that the player can take as much time as he needs to program the various pitches to be played in the pattern. This is different from many prior art programmable systems of this type wherein the player must program the pattern in synchronism with the rhythm unit, which is often difficult to do.

Figure 3:
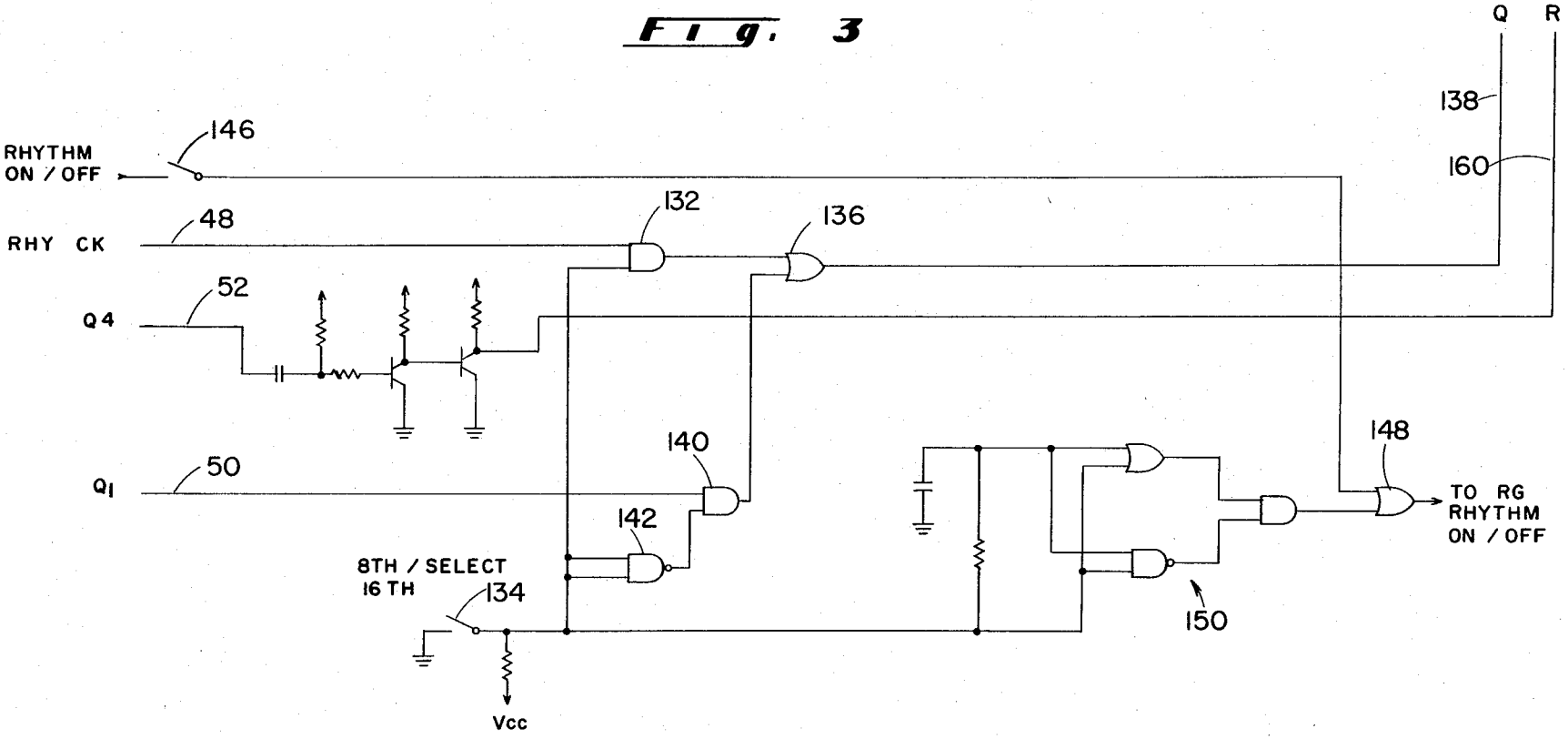
FIG. 3 is a detailed schematic of control gating for the system.

Referring now to FIG. 3, the rhythm clock signal on line 48 is connected to one of the inputs of AND gate 132, which is enabled by opening 8th/16th switch 134. This inputs the rhythm clock pulse through OR gate 136 into microprocessor 80 over Interrupt line 138 so as to cause the playback of the pattern as a 16th note measure. If switch 134 is closed, however, thereby selecting the 8th note mode, AND gate 132 is disabled and AND gate 140 is enabled through NAND gate inverter 142 so that the Q1 output of rhythm unit 46 will be connected through OR gate 136 to the interrupt input 138 of microprocessor 80. The Q1 rhythm pulse train is half the frequency of the rhythm pulse train on line 48 and will cause the programmed pattern to be played back at a slower rate as two 8th note measures. Rhythm on/off switch 146 is connected through OR gate 148 to the rhythm on/off input of rhythm unit 46, and double edge detector 150 senses a change in switch 134 for the 8th note and 16th note selection and resets the rhythm unit so that it will provide a new downbeat and start the pattern over again. This avoids the microprocessor 80 losing its place if the 8th note/16th note switch 134 should be actuated during the middle of the pattern. The downbeat pulse is connected to microprocessor 80 over line 160.

When microprocessor 80 is in the playback mode by actuating momentary switch 88, it addresses memories 82 and 84 in a successive manner to step through the patterns programmed therein in synchronism with the rhythm pulse train on interrupt line 138. The accompaniment note pattern is outputted in the form of a series of six bit binary words on outputs 64, and the bass pattern is outputted as a series of six bit binary words on outputs 72. Depending on the programming of microprocessor 80, once it has stepped through the patterns, it can repeat the patterns sequentially and always in synchronism with the rhythm clock train from rhythm unit 46.

The digital word for the accompaniment note pattern on output 64 is in pitch and octave format with the four bit pitch words appearing on lines 162, 164, 166 and 168, and the octave information appears on lines 170 and 172. Microprocessor 80 is programmed to respond to the MNPQR chord word on port 5 to transpose the data programmed into memory 82 in the key of C to the appropriate key for the chord word on port 5 and then output the pitch word on lines 162, 164, 166 and 168 for this transposed pitch. For example, if the programmed pattern is CEG but the chord word appearing on port 5 at the time of playback is D major, then the pitch words appearing on outputs 162–168 will correspond to D, F# and A.

Similarly, the pitch words for the bass pattern memory read out of memory 84 by microprocessor 80 appear on lines 174, 176, 178 and 180, and the octave words appear on outputs 182 and 184. The bass pattern output pitches will also be transposed by microprocessor 80 to be compatible with the chord word on port 5. Output 56 is the strike bit output from processor 80 for the accompaniment note pattern, and output line 186 carries the strike bit for the bass pattern. The strike bits are used to key the tones for the two patterns in synchronism with the rhythn unit 46.

Figure 4:
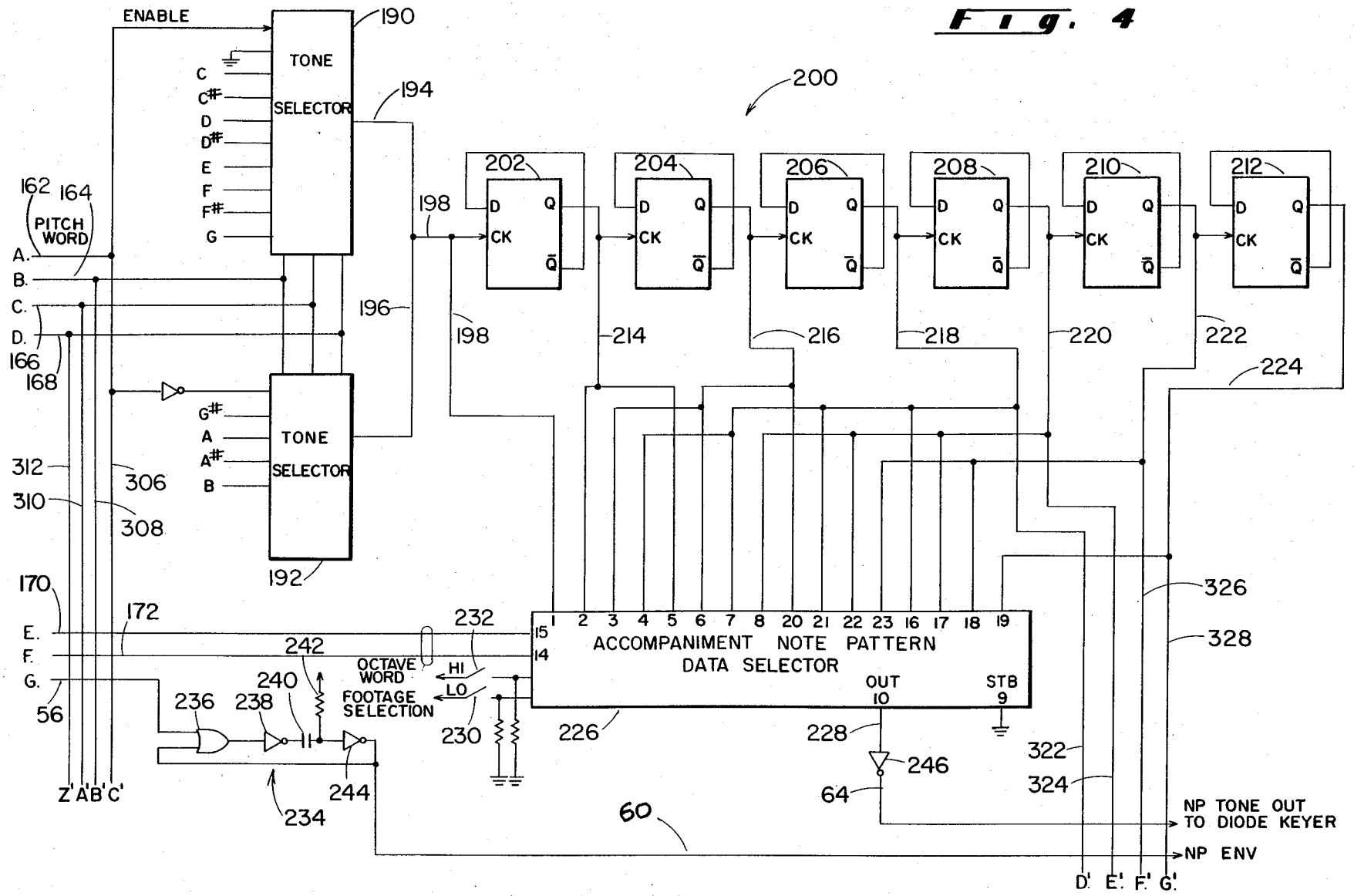
FIG. 4 is a detailed schematic of the tone selector and divider circuitry for the accompaniment note pattern.

FIG. 4 illustrates the tone selector and divider circuitry for generating tones under the control of the pitch and octave words on outputs 64. It comprises tone selectors 190 and 192 having as their inputs the twelve pitches in the chromatic scale in the TOS frequency range. Tone selectors 190 are 4512 data selectors which connect a single one of their inputs to either output line 194 or output line 196 under the control of the pitch word on inputs 162, 164, 166 and 168. The selected pitch is connected to the input 198 of divider string 200 which comprises a plurality of D-flip-flops 202, 204, 206, 208, 210 and 212 connected in series. As is well known, each of the outputs of the divide by two dividers 202–212 will have a frequency that is half the frequency of its input so that by connecting the input 198 and the various outputs 214, 216, 218, 220, 222 and 224 to the proper pins of 74C150 data selector 226, a tone having the same pitch as the tone on input 198 but divided down in frequency by octaves can be selected. The octave word on inputs 170 and 172 to data selector 226 selects one of the tones on lines 198, 214, 216, 218, 220, 222 and 224 to output 228. Data selector 226 also includes a pair of switches 230 and 232 which have the effect of shifting the frequency to either a higher or lower octave by selecting a higher or lower output 214–224 of divider string 200.

The strike pulse on line 56 triggers monostable circuit 234 comprising OR gate 236, inverter 238, capacitor 240, resistor 242 and inverter 244. The pulse is then connected to the keyer 62 over line 60, and the output tone on the output 64 of inverter 246 is connected to the tone input of keyer 62.

Figure 5:
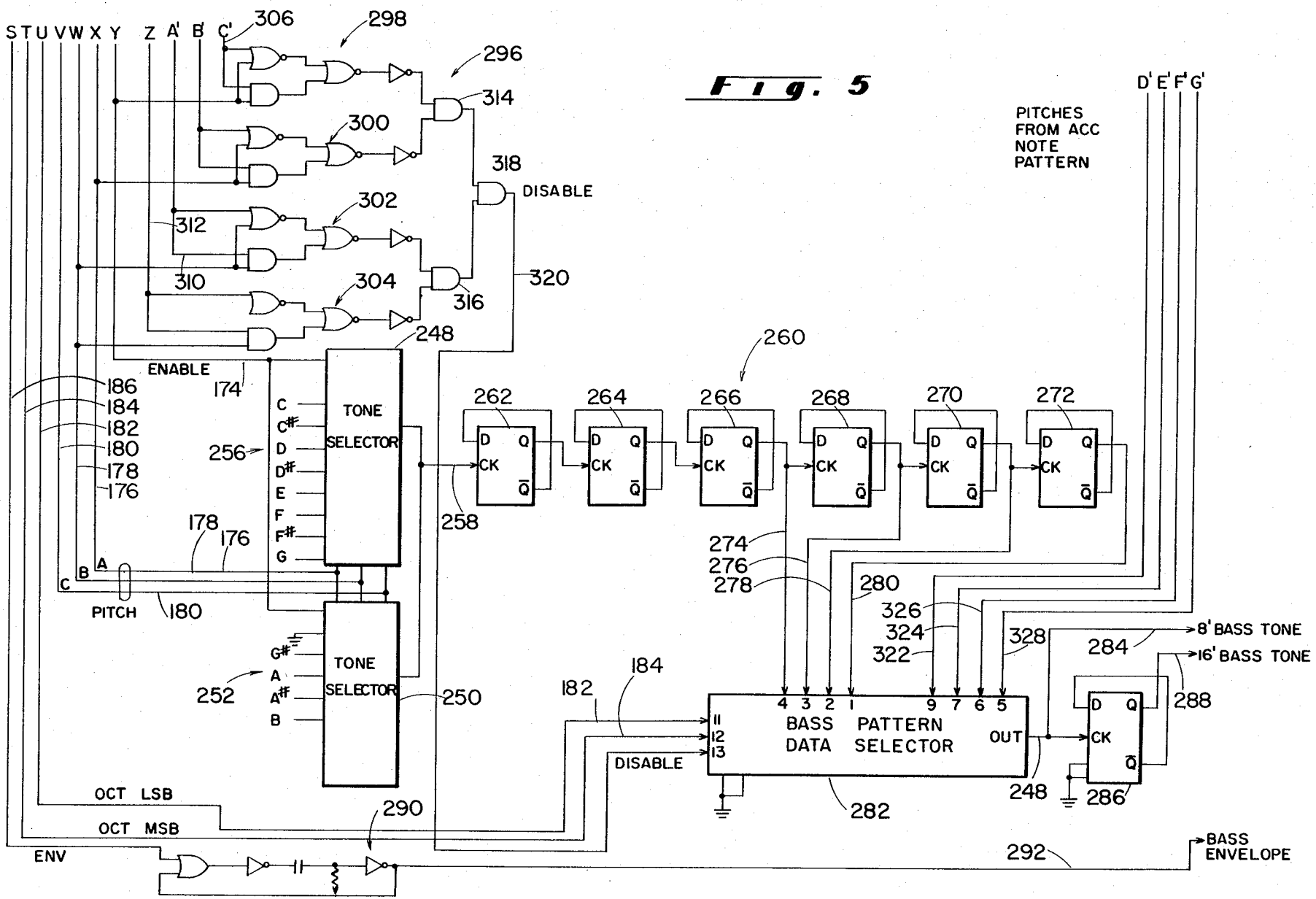
FIG. 5 is a detailed schematic of the tone selector and divider circuitry for the bass pattern.

FIG. 5 illustrates the tone selection and division circuitry for the bass pattern and, like the circuit of FIG. 4, comprises two 4512 data selectors 248 and 250 having tone inputs 252 and 256 for the twelve tones of the chromatic scale and controlled by the four bit pitch word on inputs 174, 176, 178 and 180 to select one of the tones and connect it to output 258. Divider string 260 comprises a string of 4013 D-type flip flops 262, 264, 266, 268, 270 and 272 wherein the outputs 274, 276, 278 and 280 of stages 266, 268, 270 and 272, respectively, are connected to the appropriate pins of 4512 bass pattern data selector 282. Data selector 282 selects one of inputs 274–280 to its output 284 under the control of the two bit octave word on inputs 182 and 184. Line 284 carries the eight foot bass tone directly from the output 248 of data selector 282 and 4013 flip flop 286 divides this frequency by two so as to produce the sixteen foot bass tone on output 288. The strike pulse on line 186 triggers monostable 290 and its output is connected to envelope generator by line 292.

In order to avoid the phase cancellation problem discussed earlier, means are provided for recognizing when the pitch words for the accompaniment note and bass patterns are the same. This is accomplished by exclusive OR circuit 296 which comprises a plurality of exclusive OR circuits 298, 300, 302 and 304 each having one input connected to one of the bass pattern pitch lines 174, 176, 178 and 180 and the other input connected to the respective accompaniment pattern pitch word lines 162, 164, 166 and 168 by lines 306, 308, 310 and 312, respectively. When the logic levels on the two inputs of each of exclusive OR circuits 298, 300, 302 and 304 are the same, AND gates 314 and 316 will be enabled thereby enabling AND gate 318. This produces a disabling pulse on line 320 which is connected to pin 13 of bass pattern data selector 282 thereby disabling the inputs on lines 274, 276, 278 and 280 but enabling the octave word on inputs 182 and 184 to select one of the alternative inputs 322, 324, 326 and 328 connected to the outputs 218, 220, 222 and 224 of divider stages 206, 208, 210 and 212 in FIG. 4.

Because the pitch is the same for both patterns, and only the octave may be different, any two tones can be taken from two different outputs of the same divider string 200 thereby insuring that the two tones will be in phase. If the notes are no longer of the same pitch on the next frame of the pattern, however, then the data selector will again be enabled to select one of the inputs 274, 276, 278 and 280 from divider string 260 in the usual manner.

Figure 6:
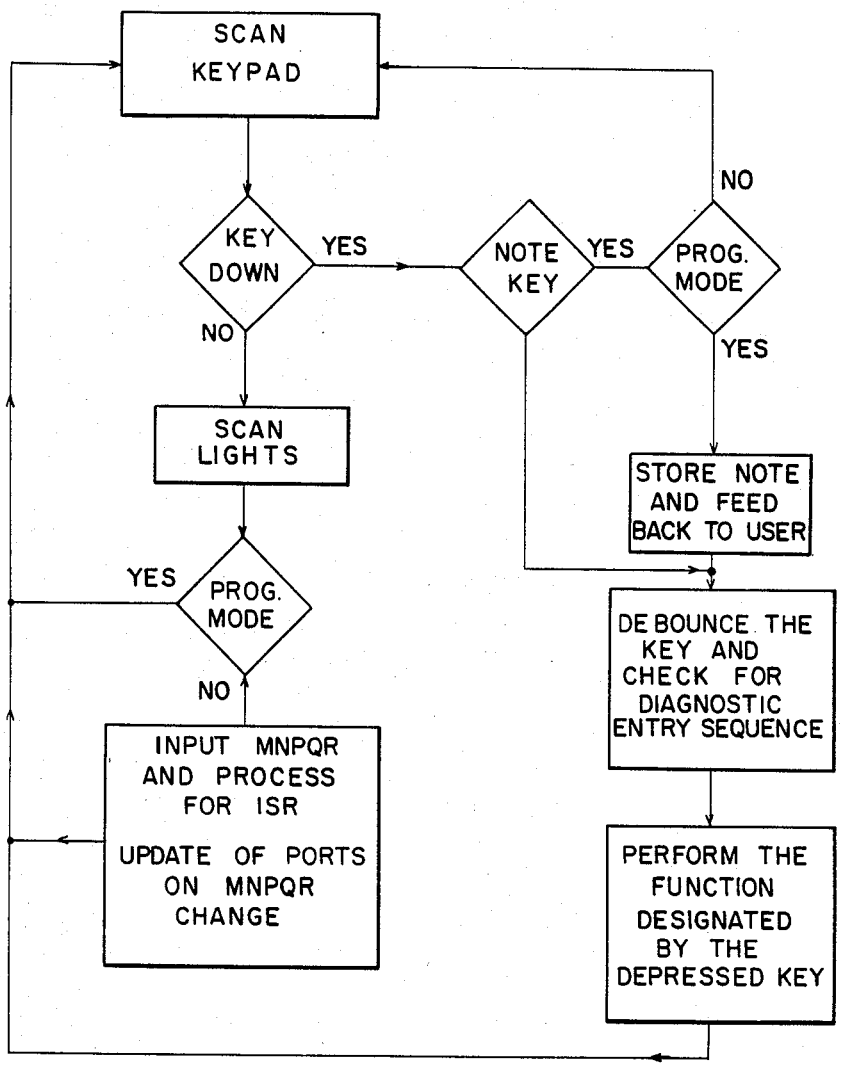
FIG. 6 is a flow chart for the microprocessor.

FIG. 6 illustrates the flow chart for microprocessor 80. The keypad 54 is scanned and if a key is actuated, the system determines whether it is a note key or not, and if it is a note key then the system must determine whether it is in the program mode or play mode by detecting the toggling of program/play key 88. If the system is not in the program mode then the routine returns and begins scanning the keypad again. If the microprocessor is in the program mode, however, that note is stored in the memory and fed back to the user by causing that note to play through the circuitry described earlier. The key is then debounced, the diagnostic entry sequence checked and then the function designated by the depressed key is performed. If the depressed key was a note key, then nothing further need be done because the note has already been sounded to give an audible feedback to the user that the data has been entered. If the depressed key is a control key, for example, the step key 92 or pattern selection key 90, then the microprocessor 90 will adjust to this condition. Then, the system returns to the scan keypad mode.

Figure 7:
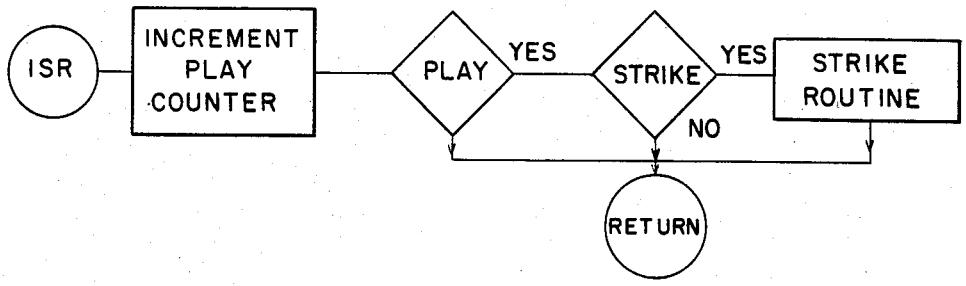
FIG. 7 is the interrupt service routine flow chart for the microprocessor.

When the keypad is scanned again and no keys are down, which will occur when the system is to be in the play mode because of the open condition of switch 88, the display lights 120 and 122 are scanned and flashed on so that the player knows which count the system is on. Then the question is again asked whether it is in a program mode, and if the answer is no the MNPQR word is inputted through port 5 to determine whether or not it should transpose the key from the key of C for the output. It also inputs and checks data from the control block 44 and then initiates the interrupt service routine shown in FIG. 7.

The interrupt service routine is initiated by a pulse on line 138 to microprocessor 80 (FIG. 2). When that occurs, it interrupts the normal microprocessor data routine and initiates the interrupt service routine of FIG. 7. This increments the play counter which steps the addressing from one memory location to the next for the next data in the pattern, determines whether the system is in the play or program mode, and if it is in the program mode, it returns the microprocessor to the main routine. If it is in the play mode, it asks whether the note should be struck by generating a strike pulse and if so, the strike routine is executed. In other words, the microprocessor steps from one frame of the patterns to the next in response to the rhythm clock train on input 138. The rhythm clock edge sets a latch internal to the microprocessor causing the control to shift from the mainline routine to the interrupt service routine to generate the proper pitch and data words for the accompaniment note and bass patterns and generate a strike pulse to enable keying of the tones.

The following is an actual program for microprocessor 80 set forth in hexadecimal notation:

| | | | | | | | | | | | | | | | |
|---|---|---|---|---|---|---|---|---|---|---|---|---|---|---|---|
| 0000=1A | 77 | 56 | 20 | 3F | 50 | 0B | 7F | 5E | 8F | FE | 40 | 24 | F8 | 25 | 1F |
| 0010=91 | F4 | 70 | 62 | 69 | 5E | 1F | 5C | 20 | 1F | 06 | 71 | B6 | 20 | 40 | B0 |
| 0020=B1 | 1B | 29 | 00 | 72 | F6 | 02 | 07 | 00 | 05 | 0A | 07 | 00 | 09 | FD | 03 |
| 0030=04 | FA | 0B | F8 | 00 | 08 | FB | F5 | 07 | FF | 09 | 02 | 00 | 05 | 01 | 06 |
| 0040=FC | F7 | F4 | FE | F9 | 00 | 01 | 02 | 03 | 04 | 05 | 06 | 07 | 08 | 09 | 0A |
| 0050=0B | 00 | 0B | 09 | 02 | 00 | 01 | 02 | 03 | 04 | 05 | 06 | 07 | 08 | 09 | 00 |
| 0060=00 | 00 | 00 | 00 | 00 | 00 | 00 | 00 | 00 | 00 | 00 | 00 | 00 | 00 | 00 | 00 |
| 0070=00 | 00 | 6E | 62 | 70 | 5C | 29 | 01 | B9 | 00 | 00 | 00 | 00 | 00 | 00 | 00 |
| 0080=00 | 00 | 00 | 00 | 00 | 00 | 00 | 00 | 00 | 00 | 00 | 00 | 00 | 00 | 00 | 00 |
| 0090=00 | 00 | 00 | 00 | 00 | 00 | 00 | 00 | 00 | 00 | 00 | 00 | 00 | 00 | 00 | 00 |
| 00A0=07 | 1E | 0A | 62 | 6C | 5E | 46 | 21 | 10 | 94 | 05 | 45 | 22 | 10 | 55 | A1 |
| 00B0=81 | 2D | 45 | 21 | 10 | 94 | 31 | 4C | 25 | 05 | 94 | 07 | 45 | 22 | 40 | 55 |
| 00C0=90 | 1D | 25 | 07 | 94 | 08 | 20 | 40 | 18 | F5 | 55 | 90 | 12 | 25 | 0B | 94 |
| 00D0=07 | 45 | 22 | 40 | 55 | 90 | 16 | 20 | 40 | 18 | F5 | 55 | 90 | 0F | 4C | 1F |
| 00E0=5E | 25 | 0F | 91 | 08 | 90 | 0A | 20 | 10 | 18 | F5 | 55 | 70 | 6B | 5E | 5C |
| 00F0=20 | 67 | DC | 5D | 46 | 21 | 01 | 84 | 04 | 29 | 01 | A7 | 46 | 21 | 08 | 94 |
| 0100=04 | 29 | 01 | A7 | 6D | 47 | 5C | 6B | 4C | 24 | 20 | 0B | 46 | 21 | 08 | 94 |
| 0110=22 | 0A | 24 | 10 | 0B | 46 | 21 | 80 | 84 | 1E | 45 | 21 | 40 | 0A | 84 | 0E |
| 0120=24 | FA | 58 | 21 | 0F | 25 | 09 | 91 | 0F | 48 | 0B | 90 | 0B | 21 | F7 | 0B |
| 0130=90 | 06 | 46 | 21 | 40 | 94 | E4 | 70 | C7 | 81 | 0F | 7F | FC | 25 | 04 | 4C |

-continued

| | | | | | | | | | | | | | | | |
|---|---|---|---|---|---|---|---|---|---|---|---|---|---|---|---|
| 0140=94 | 03 | 24 | FF | 58 | 47 | 18 | 90 | 04 | 4C | 58 | 47 | 57 | 7F | F8 | 25 |
| 0150=0F | 84 | 0D | C7 | 25 | 0B | 81 | 03 | 24 | 04 | 57 | 48 | 21 | F0 | C7 | 58 |
| 0160=62 | 6D | 4C | 57 | 46 | 21 | 08 | 84 | 16 | 45 | 21 | 02 | 84 | 0A | 48 | 25 |
| 0170=0F | 84 | 05 | 18 | 21 | 7F | B0 | 20 | 08 | 18 | F6 | 56 | 90 | 8A | 45 | 21 |
| 0180=04 | 84 | 0A | 48 | 25 | 0F | 84 | 05 | 18 | 21 | 7F | B1 | 46 | 22 | 08 | 56 |
| 0190=71 | 58 | 20 | 53 | 24 | FF | 94 | FD | 38 | 94 | F8 | A0 | 22 | 40 | 21 | 7F |
| 01A0=B0 | A1 | 22 | 40 | 21 | 7F | B1 | 62 | 6C | 4C | 0B | 1D | 03 | 1B | 1C | 2B |
| 01B0=2B | 2B | 2B | 2B | 2B | 2B | 2B | 2B | 2B | 7F | 5B | 46 | 21 | 01 | 94 | 03 |
| 01C0=70 | 5B | 70 | 50 | 71 | 52 | 70 | 51 | 71 | 53 | 43 | 18 | 15 | B4 | A4 | 18 |
| 01D0=F2 | 94 | 37 | 41 | 25 | 02 | 84 | 04 | 70 | B5 | 41 | 1F | 51 | 25 | 02 | 94 |
| 01E0=05 | 46 | 21 | 07 | B5 | 43 | 13 | 53 | 15 | 94 | E0 | 40 | 1F | 50 | 42 | 13 |
| 01F0=52 | 15 | 94 | D3 | 28 | 04 | 97 | 46 | 21 | 01 | 94 | BE | 29 | 03 | CC | 21 |
| 0200=7F | 22 | 40 | B0 | 29 | 02 | 91 | 2B | 2B | 40 | 13 | 13 | C1 | 54 | 25 | 0D |
| 0210=84 | E3 | 46 | 21 | 01 | 94 | 24 | 44 | 25 | 0B | 81 | D9 | 20 | 0A | 5A | 20 |
| 0220=A6 | 24 | FF | 94 | FD | 3A | 94 | F8 | 44 | 25 | 0F | 94 | 3A | 20 | 08 | 18 |
| 0230=F6 | 56 | 7F | 5B | 45 | 22 | 20 | 55 | 90 | 2D | 20 | 0A | 5A | 20 | A6 | 24 |
| 0240=FF | 94 | FD | 3A | 94 | F8 | 43 | 18 | 15 | B4 | A4 | 18 | F2 | 84 | A6 | 44 |
| 0250=25 | 0B | 91 | 13 | 57 | 20 | D0 | B4 | A4 | 21 | 08 | 94 | 05 | 47 | 22 | 10 |
| 0260=57 | 47 | 22 | C0 | 18 | B0 | 28 | 04 | 97 | 41 | 25 | 02 | 94 | 05 | 46 | 21 |
| 0270=07 | B5 | 43 | 18 | 15 | B4 | A4 | 18 | F2 | 94 | EC | 20 | F0 | B4 | 70 | B5 |
| 0280=20 | 14 | 5A | 20 | A6 | 24 | FF | 94 | FD | 3A | 94 | F8 | 47 | 18 | 29 | 01 |
| 0290=FF | 2A | 00 | 52 | 6E | 62 | 4C | 8E | 44 | 8D | 94 | 10 | 4C | 25 | 01 | 81 |
| 02A0=06 | 70 | 5C | 29 | 05 | 26 | 24 | 01 | 5C | 90 | 03 | 70 | 5C | 44 | 25 | 0C |
| 02B0=94 | 59 | 20 | 01 | E6 | 56 | 21 | 01 | 94 | 2E | 45 | 21 | 20 | 94 | 1B | 62 |
| 02C0=69 | 4C | 25 | 00 | 84 | 14 | 25 | 08 | 91 | 10 | 46 | 21 | 04 | 84 | 07 | 46 |
| 02D0=22 | 40 | 56 | 90 | 05 | 46 | 22 | 80 | 56 | 20 | 20 | 18 | F5 | 55 | 70 | 62 |
| 02E0=69 | 5E | 1F | 5C | 29 | 03 | B0 | 20 | 08 | 18 | F6 | 56 | 45 | 21 | 20 | 94 |
| 02F0=04 | 29 | 01 | B9 | 62 | 68 | 71 | 50 | 18 | DC | 24 | 66 | D0 | 94 | 03 | 02 |
| 0300=16 | 5D | 3C | 81 | 03 | 7F | 5C | 29 | 01 | B9 | 46 | 21 | 01 | 94 | 04 | 29 |
| 0310=03 | B0 | 44 | 25 | 0D | 94 | 08 | 20 | 02 | E6 | 56 | 29 | 01 | B9 | 25 | 0E |
| 0320=94 | 32 | 20 | 04 | E6 | 56 | 45 | 21 | 20 | 94 | 21 | 62 | 69 | 4C | 25 | 00 |
| 0330=84 | 14 | 25 | 08 | 91 | 10 | 46 | 21 | 04 | 94 | 07 | 46 | 22 | 40 | 56 | 90 |
| 0340=05 | 46 | 22 | 80 | 56 | 70 | 62 | 69 | 5E | 1F | 5C | 20 | 08 | 18 | F6 | 56 |
| 0350=29 | 01 | B9 | 25 | 0F | 94 | 4A | 62 | 69 | 4C | 50 | 24 | 20 | 0B | 46 | 21 |
| 0360=04 | 94 | 05 | 0A | 24 | 10 | 0B | 46 | 21 | 04 | 84 | 08 | 20 | 40 | 18 | F6 |
| 0370=56 | 90 | 06 | 20 | 80 | 18 | F6 | 56 | 46 | 21 | 08 | 84 | 06 | 47 | 22 | 40 |
| 0380=90 | 03 | 20 | 0F | 5C | 20 | 08 | 18 | F6 | 56 | 62 | 68 | 20 | 67 | DC | 5D |
| 0390=4C | 1F | 5C | 25 | 0F | 81 | 07 | 70 | 62 | 69 | 5E | 1F | 5C | 29 | 01 | B9 |
| 03A0=46 | 22 | 08 | 56 | 90 | F8 | 2B | 2B | 2B | 2B | 2B | 2B | 2B | 2B | 2B | 2B |
| 03B0=44 | 25 | 0F | 94 | 18 | 45 | 22 | 20 | 55 | 62 | 68 | 20 | 67 | DC | 5D | 4C |
| 03C0=1F | 5C | 25 | 0F | 81 | 07 | 70 | 62 | 69 | 5E | 1F | 5C | 46 | 21 | 10 | 94 |
| 03D0=05 | 45 | 22 | 10 | 55 | A5 | 14 | 13 | 50 | A0 | 81 | 04 | 71 | C0 | 50 | 40 |
| 03E0=25 | 1F | 94 | 16 | 46 | 21 | 20 | 94 | 14 | 45 | 21 | 08 | 94 | 0F | 20 | 1F |
| 03F0=06 | 20 | 08 | 18 | F6 | 56 | 29 | 01 | B9 | 06 | 90 | EE | 02 | 25 | 1F | 84 |
| 0400=F1 | 45 | 21 | 80 | 84 | 0D | 45 | 21 | 01 | 94 | 13 | 20 | 80 | 18 | F5 | 55 |
| 0410=90 | DD | 45 | 21 | 01 | 84 | 07 | 45 | 22 | 80 | 55 | 90 | D2 | 46 | 22 | 08 |
| 0420=56 | 2A | 00 | 25 | 2C | 2A | 00 | 25 | 45 | 21 | 01 | 84 | 03 | 2C | 1A | 02 |
| 0430=8E | 16 | 52 | 18 | 1F | C7 | 84 | 52 | 1A | 62 | 6B | 4C | 24 | 20 | 0B | 70 |
| 0440=C2 | 57 | 81 | 0F | 7F | FC | 25 | 04 | 4C | 53 | 94 | 02 | 33 | 42 | 18 | 52 |
| 0450=90 | 03 | 4C | 53 | 7F | F3 | 25 | 0F | 84 | 0E | C2 | 25 | 0B | 81 | 03 | 24 |
| 0460=04 | 52 | 43 | 21 | F0 | C2 | 53 | 0A | 25 | 2F | 43 | 91 | 13 | 25 | 0F | 84 |
| 0470=07 | 21 | 3F | 18 | 21 | 7F | B0 | 0A | 24 | 10 | 0B | 47 | 52 | 90 | C1 | 25 |
| 0480=0F | 84 | 07 | 21 | 3F | 18 | 21 | 7F | B1 | 1B | 29 | 01 | B9 | 2B | 2B | 2B |
| 0490=2B | 2B | 2B | 2B | 2B | 2B | 2B | 08 | 62 | 6A | 7F | FB | 84 | 04 | 68 | 90 |
| 04A0=13 | 45 | 21 | 10 | 84 | 0E | 72 | 5A | 20 | A6 | 24 | FF | 94 | FD | 3A | 94 |
| 04B0=F8 | 90 | 2B | 20 | E0 | B4 | 4C | 50 | 18 | 15 | 14 | B5 | 72 | 5A | 20 | A6 |
| 04C0=24 | FF | 94 | FD | 3A | 94 | F8 | 70 | B5 | 20 | D0 | B4 | 40 | 18 | 14 | B5 |
| 04D0=72 | 5A | 20 | A6 | 24 | FF | 94 | FD | 3A | 94 | F8 | 70 | B5 | 20 | F0 | B4 |
| 04E0=1A | 20 | 10 | 18 | F6 | 56 | A5 | 21 | 01 | 84 | 06 | 46 | 22 | 10 | 56 | 1B |
| 04F0=46 | 21 | 07 | B5 | 20 | B0 | B4 | 72 | 5A | 20 | A6 | 24 | FF | 94 | FD | 3A |
| 0500=94 | F8 | 20 | F0 | B4 | 70 | B5 | 20 | 20 | 18 | F6 | 56 | A5 | 15 | 81 | 05 |
| 0510=46 | 22 | 20 | 56 | 20 | 70 | B4 | 1A | 45 | 21 | F0 | 55 | A5 | 21 | 0F | C5 |
| 0520=55 | 20 | F0 | B4 | 1B | 0C | 79 | 52 | 2A | 00 | 55 | 8E | 16 | 18 | B5 | 20 |
| 0530=C0 | B4 | 70 | 5A | 20 | A6 | 24 | FF | 94 | FD | 3A | 94 | F8 | 20 | F0 | B4 |
| 0540=32 | 42 | 81 | E5 | 77 | B5 | 20 | B0 | B4 | 70 | 5A | 20 | A6 | 24 | FF | 94 |
| 0550=FD | 3A | 94 | F8 | B5 | 5A | 20 | A6 | 24 | FF | 94 | FD | 3A | 94 | F8 | 20 |
| 0560=F0 | B4 | 20 | 3F | 0B | 73 | 50 | 20 | 53 | 5E | 24 | FF | 25 | 4F | 94 | 03 |
| 0570=20 | 4B | 25 | 3F | 94 | 03 | 20 | 53 | 8F | F0 | 57 | 0A | 24 | F8 | 0B | 47 |
| 0580=30 | 81 | E7 | 20 | 36 | F6 | 56 | 29 | 02 | D9 | FF | FF | FF | FF | FF | FF |

Although a particular program is described above, the advantage to utilizing a microprocessor is that the programming can be changed depending upon the particular needs of the system. Accordingly, the invention is not limited to any particular program and the above program is included only by way of example.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic keyboard musical instrument comprising:

a first controllable tone generator means including a divider string for producing on an output of the divider string a selectable accompaniment tone, a second controllable tone generator means including a divider string for producing on an output of the divider string of said second controllable means a selectable bass tone, accompaniment note pattern generator means for controlling said first controllable means and said first divider means to automatically produce a rhythmic accompaniment pattern of a series of the accompaniment tones having respective selected frequencies, bass pattern generator means for controlling said second controllable means to automatically produce a rhythmic bass pattern of a series of the bass tones having respective selected frequencies, and means responsive to said accompaniment and bass pattern generator means when an accompaniment tone and a bass tone simultaneously selected, respectively, by the accompaniment and bass pattern generator means are of the same pitch and are octavely related for disabling one of said first and second controllable means and causing the other of said first and second controllable means to produce both of said octavely related tones on respective outputs of the divider string of said other controllable means.

2. The musical instrument of claim 1 wherein said first and second controllable means are tone selectors fed by a plurality of tones, and said accompaniment and bass pattern generator means produce respective sets of binary words corresponding to the tones to be produced, said sets of binary words are connected respectively to control inputs of said first and second controllable means.

3. The musical instrument of claim 2 wherein means for disabling comprises comparator means for comparing the sets of binary words with each other and disabling said one controllable means when compared binary words correspond to the same pitch.

4. The musical instrument of claim 2 wherein said accompaniment and bass generator means comprise respective memories each having a plurality of musical patterns stored therein and means for addressing said memories to produce said sets of said binary words corresponding to said patterns, said memories being player programmed.

* * * * *